United States Patent [19]

Ostrander

[11] Patent Number: 4,925,087

[45] Date of Patent: May 15, 1990

[54] PACKAGING CONTAINER WITH DISPLAY WINDOW

[75] Inventor: Charles Ostrander, Bexley, Ohio

[73] Assignee: R. G. Barry Corporation, Pickerington, Ohio

[21] Appl. No.: 403,403

[22] Filed: Sep. 6, 1989

[51] Int. Cl.[5] ..... B65D 25/00

[52] U.S. Cl. ..... 229/120.03; 229/120.15; 229/162; 206/45.34; 206/459

[58] Field of Search ..... 206/45.34, 45.31, 45.14, 206/45.15, 45.19; 229/120.03, 120.15, 162

[56] References Cited

U.S. PATENT DOCUMENTS 2,321,473 6/1943 Ferguson ..... 229/161 X 3,186,622 6/1965 Palmer ..... 229/120.03

*Primary Examiner*—William Price

*Attorney, Agent, or Firm*—Watson, Cole, Grindle & Watson

[57] ABSTRACT

A packaging container adapted to attractively display an article contained therein as well as providing suitable space within the container for storage of a companion, non-displayed article. The packaging container comprises a front wall, a back wall, a top wall, two side walls and means for forming a top and a bottom joined to each other so as to form an enclosure of a generally rectangular configuration. The front wall has an opening therein for display of an article contained within the enclosure. The container further includes a shelf within the enclosure extending from the back wall to the front wall to provide a supporting surface for the displayed article. The shelf is spaced upwardly from the means forming the bottom of the enclosure so as to provide a space for storage of one or more articles therein.

24 Claims, 3 Drawing Sheets

PACKAGING CONTAINER WITH DISPLAY WINDOW

BACKGROUND OF THE INVENTION

The present invention relates to a construction for a packaging container and, more particularly, to a packaging container construction which is adapted to function as a display type packaging container which enhances the appearance of goods or articles contained therein and is relatively simple and inexpensive to manufacture and assemble.

In the retail merchandising of products to customers, it has been long found that the sales are generally enhanced if the particular product being offered for sale is attractively presented to the customer at the point of sale. Many packaging constructions are known for this purpose and one particularly popular constuction is a generally rectangularly shaped package containing the product which has a fairly large opening or window therein so the product can be viewed from the exterior. Attractiveness of the packaging may be further enhanced if the opening is covered with a sheet of transparent material to give the appearance of a glass-paned window.

Furthermore, it is has been found, for whatever reasons, that products or articles sold in pairs or in multiples of articles, that the appearance of the article tends to be enhanced if only one of the articles can be viewed by the prospective purchaser. Perhaps the appearance of a sole article gives a cleaner or neater appearance or by visually presenting only one article, the purchaser can more readily view all the features of the article. However, to present only one item of a pair or set presents several problems for the retailer in that it becomes difficult to keep stock of the inventory of the remainder of the articles not on display. In many cases, these items are improperly stored which may result in soiling or damage to these items. In the worst case, some of the non-displayed items or articles could become lost or misplaced or difficulty encountered in locating the matching item in the proper size or color. In any of these situations, the merchant or retailer may be caused to suffer considerable inconvenience or even the monetary loss of the complete pair or set of articles since this inventory must be replaced. At a minimum, storage and retrieval of the non-displayed items is a burden to the retailer.

SUMMARY OF THE INVENTION

It is therefore a feature of the present invention to provide a construction for a packaging container which serves as an attractive display package to enhance the appearance of an article so as to improve sales of the contained product or article.

It is another feature of the invention to provide a packaging container which is constructed such that a single item of a pair or set of items can be attractively displayed while the remainder of the pair or set can be contained in the container but easily accessible to the ultimate purchaser of the set.

It is also a feature of the present invention to provide a packaging container which can be easily and simply constructed from an integral blank capable of being produced on conventional fiberboard box and container forming equipment.

Briefly, in its broader aspects, the present invention comprehends a packaging container comprising a front wall, a back wall, two side walls, means for forming a top and means for forming a bottom joined to each other so as to form an enclosure of a generally rectangular configuration, the front wall having an opening therein for display of an article contained within the enclosure, the container further including a shelf within the enclosure extending from the back wall to the front wall to provide a supporting surface for the displayed article, the shelf being spaced upwardly from the means forming the bottom of the enclosure so as to provide a space for storage of one or more articles.

The present invention further comprehends a packaging container comprising a front wall, a back wall, two side walls means for closing the top and means for closing the bottom joining each other to form an enclosure of a generally rectangular configuration, the front wall having an opening therein for display of an article contained with in the enclosure, the container further including a shelf formed by cutting the front wall in forming the window along three of its sides and extending from a fold line on the front wall to the back wall for supporting the article to be displayed, the shelf being spaced from the means forming the bottom such that one or more articles can be concealed therebeneath and supported by means on the back wall.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 2:
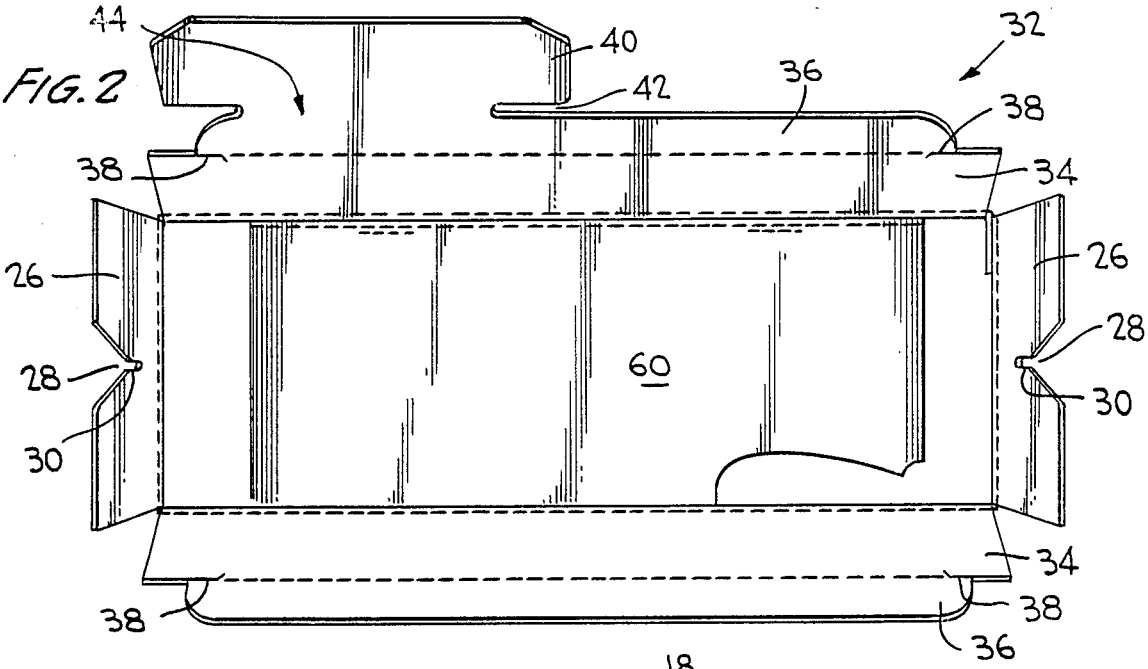
FIG. 2 is a top view of the container of FIG. 1.
Figure 1:
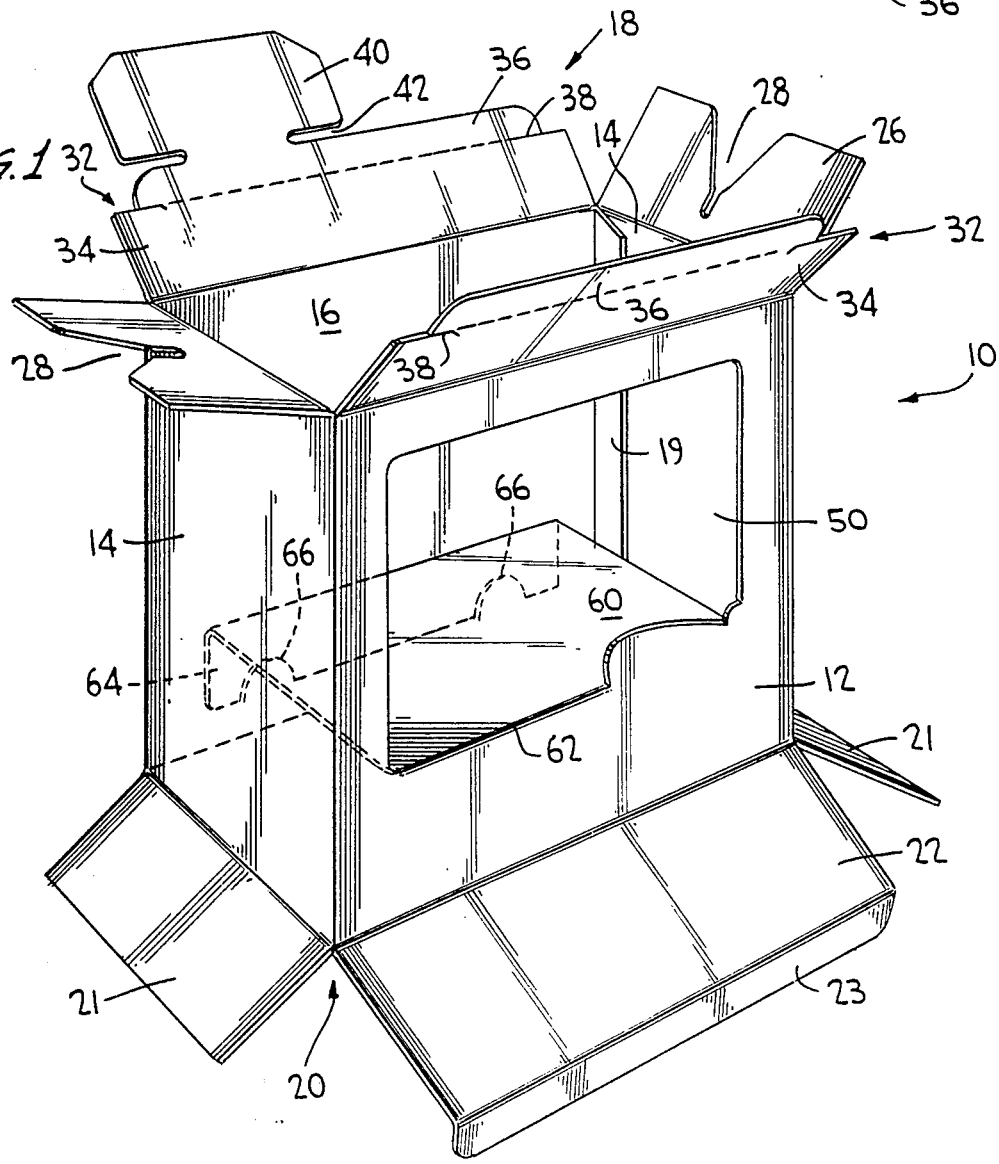
FIG. 1 is a perspective view of a packaging container according to the present invention, the container being shown in its open position and with a portion of the article supporting shelf contained therein shown in phantom lines.

Referring first to FIGS. 1 and 2, shown is packaging container 10 in accordance with the present invention, the container being particularly adapted for displaying various types of single articles in retail merchandising while providing a convenient storage space for storing other complementary articles which may form a pair or set with the article being displayed such as articles of footwear, gloves and other personal effects.

Container 10 is of generally rectangular configuration having generally planar front wall 12, two planar side walls 14 and planar back wall 16. The basic box-like configuration for container 10 may be formed by folding connecting walls and providing suitable tabs on various walls for engaging the adjacent walls or alternatively by suitable adhesives joining the walls to one another in conventional manners as is known in the art. For example, one tab 19 is shown extending between back wall 16 and right hand side wall 14 as viewed in FIG. 1.

FIGS. 1 and 2 also illustrate the manner in which top 18 and bottom 20 of packaging container 10 are each provided with tabs and flaps such that the container 10 can be securely closed yet easily opened if desired, the two drawing Figures showing the tabs and flaps in their open position. Container bottom 20 has two side flaps 21 adapted to be folded inwardly so as to be coplanar with the bottom of container 10 and perpendicular to side walls 14. Container bottom 20 also includes closure flap 22 adapted to overlie the two side flaps 21, this closure flap including extension 23 adapted to be inserted between the rear edges of side flaps 21 and the lower inner edge of back wall 16 to complete the closure of bottom 20 of container 10. Preferably, insertable tab 24 (see FIG. 5) may be provided on back wall 16 which engages with cooperating slit 25 between extension 23 and closure flap 22 to provide additional rigidity and security for bottom portion 20 of packaging container 10.

The closure for top 18 of packaging container 10 is slightly more complicated than that for bottom 20, the top closure comprising two virtually identical side tabs 26, each having a centrally located V-shaped notch 28 extending from the upper free edge of the tab, the lower point of the V-shape of the notch having a narrow short extension 30 with generally parallel sides.

Front wall 12 and back wall 16 each have extending flap 32 including a lower flap portion 34 adjacent the respective walls and extending across their entire width as well as a parallel narrowed upper flap portion 36 of slightly smaller dimensions as compared with the lower flap portions. The distal ends of each of narrowed flap portions 36 have short slits 38 extending along the fold line between the upper narrowed portion and lower flap portion 34. Lower flap portions 34 preferably have a depth or dimension between their respective walls and upper flap portions 36 which is approximately equal to one half of the width of flaps 26 or for that matter the width of side walls 14. Attached to and offset from upper narrowed flap portion 36 which extends from back wall 16 is generally rectangular ear portion 40 having two cut-outs 42 extending toward each other forming a narrowed neck portion 44 between the ear and the upper flap portion.

To assemble the closure for top 18 of packaging container 10, tabs 26 are folded inwardly such that they are approximately coplanar along the fold line between flaps 32 and walls 12 and 16 respectively. Thereafter, flaps 32 of the front wall 12 and back wall 16 are folded inwardly such that upper narrowed flap portions 36 extend downwardly adjacent to each other toward the interior of the container 10 and slits 38 at their distal ends engage with extensions 30 of notches 28 on side tabs 26. Ear 40 also extends downwardly into container 10 proper and left hand cut-out 42 also engages notch 28 in tab 26. The assembled container 10 is more clearly illustrated in the front view of FIG. 3 and in the side cross-sectional view of FIG. 4. It should be noted that in the embodiment shown, the majority of ear 40 is visible through opening 50 which provides a convenient location for placing advertising material such as a logo for the product or the like or even consumer information as to the characteristics of the contained product.

Located in front wall 12 is opening or window 50 which allows an article or articles contained within container 10 to be readily viewed by a prospective purchaser. Window or opening 50 may be open or, alternatively, can be covered with a suitable sheet of transparent material (not shown) to further enhance the appearance of container 10 and to protect the contents of the container from dirt, dust and the like as well as from abusive handling by customers. The transparent material can be secured to the edges of opening 50 by a suitable adhesive or the like. In the embodiment shown, opening 50 occupies approximately one half of the surface of front wall 12 and is of somewhat arbitrary configuration and shape. However, opening 50 can take any desired size, shape and configuration.

Figure 3:
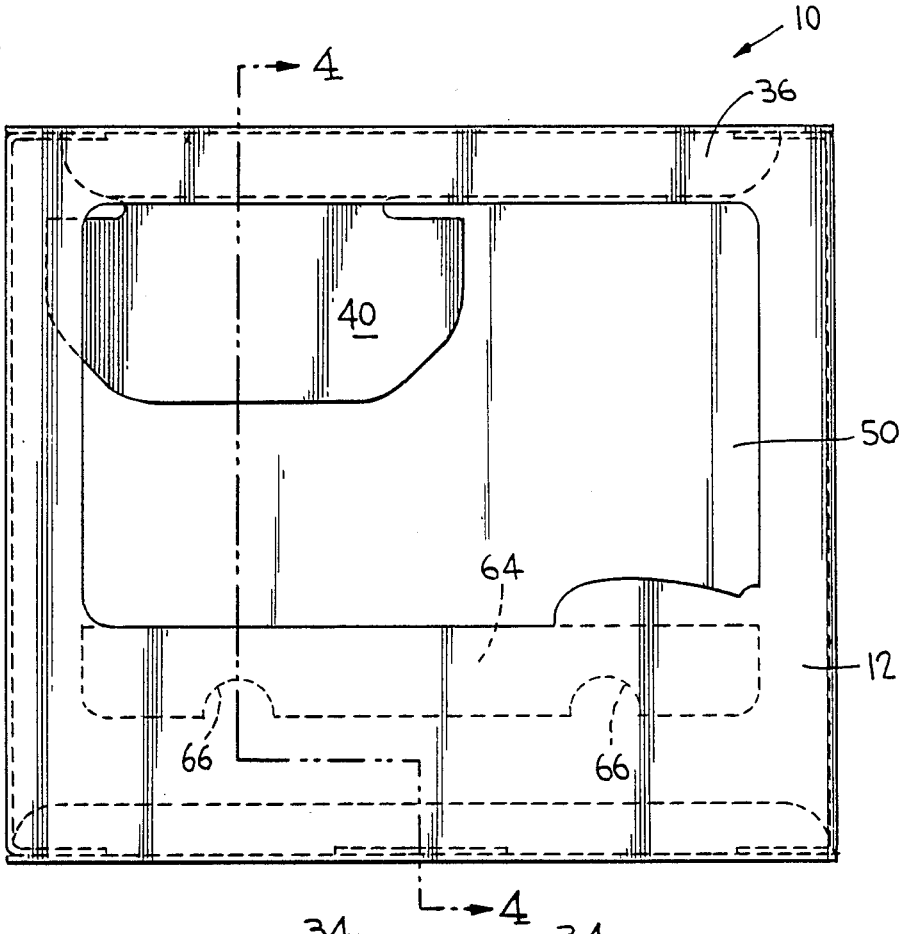
FIG. 3 is a front view of the container of FIG. 1 with various interior components being shown in phantom lines.
Figure 4:
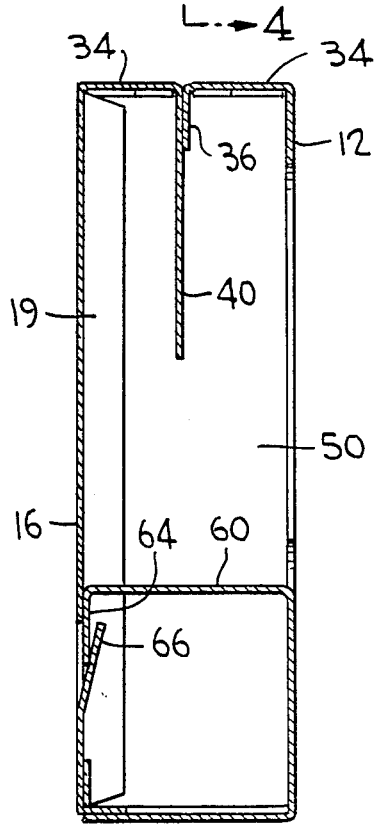
FIG. 4 is a cross-sectional view of the container taken along line 4—4 of FIG. 3.

Container 10 further includes shelf 60 which is spaced from and is generally parallel with container bottom 20. In a preferred embodiment, shelf 60 is punched or cut out on three sides from the planar sheet forming front wall 12 such that the shelf can be folded inwardly into container 10 along fold line 62 (see FIGS. 1 and 5). Shelf 60 includes a downwardly extending lip 64 which engages two semicircular cut-outs 66 formed on back wall 16 so as to provide support for shelf 60 as is best shown in FIGS. 1 and 3. Alternatively, depending upon the dimension of shelf 60 and its spacial relationship with bottom 20, lip 64 could also extend all the way to the bottom of container 10 and serve as a support for the rearward side of the shelf opposed from window or opening 50.

Figure 5:
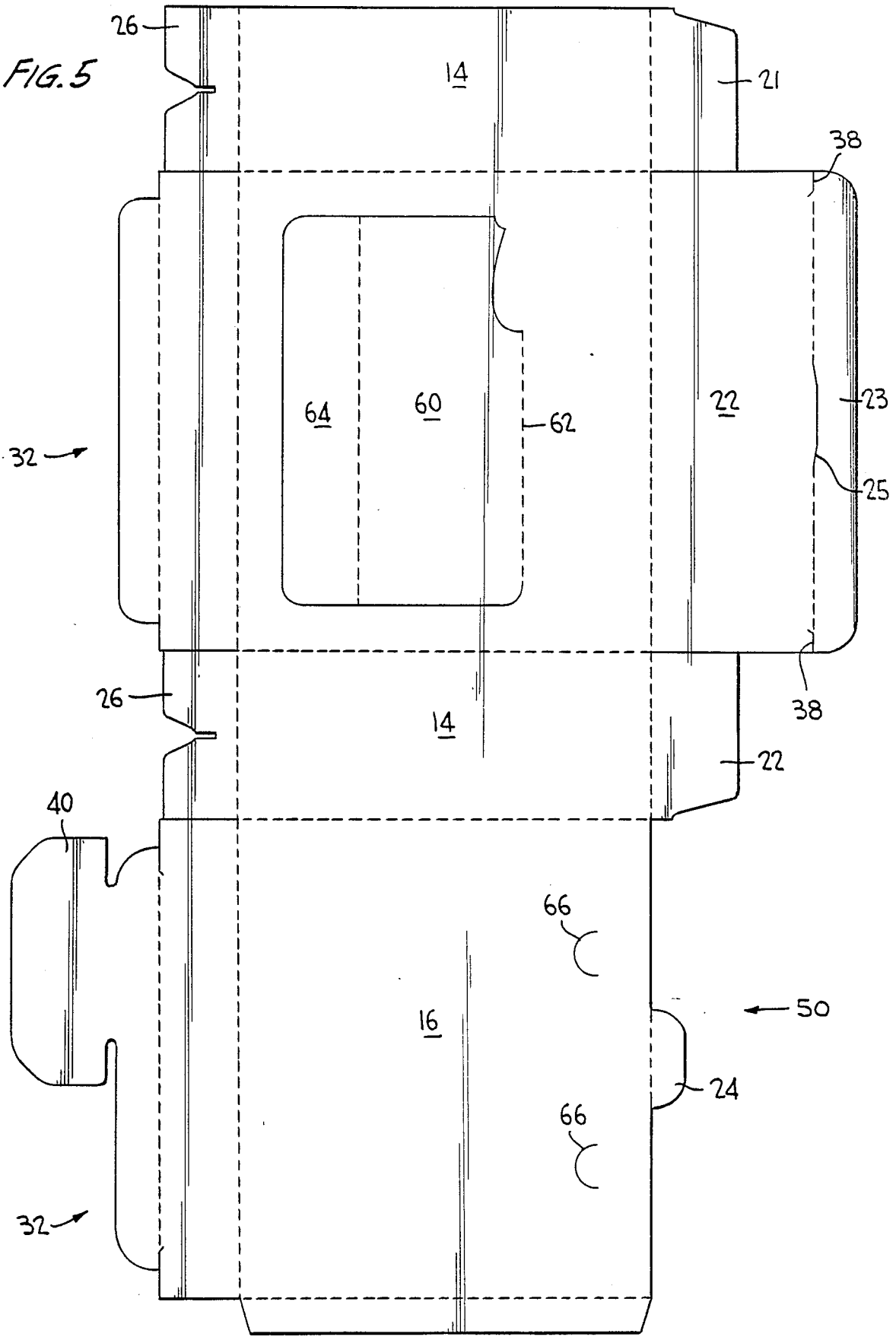
FIG. 5 is a plan view of a blank suitable for constructing the container shown in FIGS. 1 through 4.

An important feature of the invention is that container 10 can be formed from a one-piece blank of sheet material thereby saving on manufacturing and assembly costs. An embodiment of one such blank for forming container 10 of FIG. 1 through 4 is illustrated in FIG. 5. Blank 50 is cut or die punched from a sheet or web of suitable material such as fiberboard, pasteboard, cardboard or the like so as to have the configuration shown including the outline of opening 50 and a adhesive 52 is applied to the various portions of the walls to form an enclosure. Fold lines as shown by the dashed lines are formed on the blank 50 by scoring, bending and the like as is known in the art and various slits and tabs formed by the cutting, punching or the like. If desired, a transparent sheet may be applied over opening 50 by suitable means such as adhesives, tape, melting by the application of heat or similar methods known in the art. The assembly of blank 50 into a completed package or container 10 may be accomplished by the procedure as described above.

From the foregoing, it is readily apparent that packaging container 10 according to the invention provides an attractive display container for various types of articles and items, particularly those items sold in pairs and sets. While the containers of the invention have found particulary adaptability as containers for footwear such as slippers and the like, their usefulness is not thereby so limited. For footwear, the interior shelf enables one item of a pair of footwear to be attractively displayed in a profile view thereby providing a cleaner and more attractive presentation of the product while still allowing easy accessability to the concealed item or items forming the remainder of the pair or set. A further feature is that the container is also particularly adaptable to be formed from a one piece blank thereby minimizing the costs associated with producing and assemblying the container.

While there has been shown and described what is considered to be preferred embodiments of the present invention, it will be apparent to those skilled in the art to which the invention pertains that various changes and modifications may be made therein without departing from the invention as defined in the appended claims.

I claim:

1. A packaging container comprising a front wall, a back wall, two side walls, means for forming a top and means for forming a bottom joined to each other so as to form an enclosure of a generally rectangular configuration, said front wall having an opening therein for display of an article contained within the enclosure, the container further including a shelf within the enclosure extending from and integral with the front wall to the back wall to provide a supporting surface for the displayed article, the shelf being supported by the front wall and being spaced upwardly from the means forming the bottom of the enclosure so as to provide a space for storage of one or more articles, wherein the shelf is formed by cutting the front wall and folding the shelf inwardly.

2. A packaging container in accordance with claim 1 wherein the front wall, back wall, and side walls are formed from an integral blank of material.

3. A packaging container in accordance with claim 1 wherein the front wall includes an integral closure flap forming at least a portion of the means for forming the container bottom.

4. A packaging container in accordance with claim 3 wherein the closure flap includes a depending flange.

5. A packaging container in accordance with claim 3 wherein the side walls each include a flap forming at least a portion of the means for forming the container bottom.

6. A packaging container comprising a front wall, a back wall, two side walls, means for forming a top and means for forming a bottom joined to each other so as to form an enclosure of a generally rectangular configuration, said front wall having an opening therein for display of an article contained within the enclosure, the container further including a shelf within the enclosure extending from the front wall to the back wall to provide a supporting surface for the displayed article, the shelf being supported by the front wall and being spaced upwardly from the means forming the bottom of the enclosure so as to provide a space for storage of one or more articles, wherein the shelf adjacent the back wall is folded to form a downwardly extending lip which helps support the shelf to the back wall, and wherein the means for securing the lip of the shelf includes cut-outs in the back wall into which the lip is inserted.

7. A packaging container in accordance with claim 6 wherein the front wall, back wall and side walls are formed from an integral blank of material.

8. A packaging container in accordance with claim 7 wherein the shelf is integral with the front wall.

9. A packaging container in accordance with claim 6 wherein the front wall includes an integral closure flap forming at least a portion of the means for forming the container bottom.

10. A packaging container in according with claim 9 wherein the closure flap includes a depending flange.

11. A packaging container in accordance with claim 9 wherein the side walls each includes a flap forming at least a portion of the means for forming the container bottom.

12. A packaging container in accordance with claim 7 wherein each tab of the side walls include a notch.

13. A packaging container in accordance with claim 12 wherein the upper portion of the flaps for the front wall and the back, wall engage the notches in the tabs of the side walls.

14. A packaging container in accordance with claim 7 wherein one of the flaps of the front and back walls includes an ear visible through the window.

15. A packaging container comprising a front wall, a back wall, two side walls, means for closing the top and means for closing the bottom joining each other so as to form an enclosure of a generally rectangular configuration, said front wall having an opening therein for display of an article contained with in the enclosure, the container further including a shelf formed by cutting the front wall in forming the window along three of its sides and extending from a fold line on the front wall to the back wall for supporting the article to be displayed, the shelf being spaced from the means forming the bottom such that one or more articles can be concealed therebeneath and supported by means on the back wall.

16. A packaging container in accordance with claim 15 wherein the front wall, back wall, shelf and side walls are formed from an integral blank of material.

17. A packaging container in accordance with claim 16 wherein the shelf adjacent the back wall is folded to form a downwardly extending lip which helps support the shelf and means are included for securing the lip of the shelf to the back wall.

18. A packaging container in accordance with claim 17 wherein the means for securing the lip of the shelf includes cut-outs in the back wall into which the lip is inserted.

19. A packaging container comprising a front wall, a back wall, two side walls, means for forming a top and means for forming a bottom joined to each other so as to form an enclosure of a generally rectangular configuration, said front wall having an opening therein for display of an article contained within the enclosure, the container further including a shelf within the enclosure extending from the front wall to the back wall to provide a supporting surface for the displayed article, the shelf being supported by the front wall and being spaced upwardly from the means forming the bottom of the enclosure so as to provide a space for storage of one or more articles, wherein the means for forming the top of the container includes a tab on each side wall, a flap on the front wall, and a flap on the back wall, the flaps of the front wall and of the back wall each having a lower portion of a width approximately one half the width of a side wall and each including an upper portion capable of being folded so as to extend downwardly into the container.

20. A packaging container in accordance with claim 19 wherein the front wall, back wall and side walls are formed from an integral blank of material.

21. A packaging container in accordance with claim 20 wherein the shelf is integral with the front wall.

22. A packaging container in accordance with claim 19 wherein the front wall includes an integral closure flap forming at least a portion of the means for forming the container bottom.

23. A packaging container in according with claim 22 wherein the closure flap includes a depending flange.

24. A packaging container in accordance with claim 22 wherein the side walls each includes a flap forming at least a portion of the means for forming the container bottom.

* * * * *